United States Patent [19]

Colecchi et al.

[11] 4,013,160

[45] Mar. 22, 1977

[54] RIBBON TENSIONING DEVICE FOR RIBBON CARTRIDGE

[75] Inventors: Paul S. Colecchi; Cezary Kotecki, both of Des Plaines, Ill.

[73] Assignee: A. B. Dick Company, Chicago, Ill.

[22] Filed: Oct. 14, 1975

[21] Appl. No.: 621,686

[52] U.S. Cl. ..... 197/151; 242/75.45

[51] Int. Cl.[2] ..... B41J 33/52; B41J 33/12

[58] Field of Search ..... 197/151, 168; 226/195; 242/55.17, 75.2, 75.4, 75.45, 156.1, 194, 199

[56] References Cited

UNITED STATES PATENTS

| | | | |
|---|---|---|---|
| 2,792,653 | 5/1957 | Bozich | 242/75.2 UX |
| 2,804,508 | 8/1957 | Mastling et al. | 242/199 X |
| 2,963,236 | 12/1960 | Grosser et al. | 242/75.45 |
| 3,513,957 | 5/1970 | Ricciardi et al. | 197/151 |
| 3,601,654 | 8/1971 | Long et al. | 242/199 UX |
| 3,632,052 | 1/1972 | Read | 197/151 UX |
| 3,643,779 | 2/1972 | Anderson et al. | 197/168 X |
| 3,685,893 | 8/1972 | Castedello | 242/199 X |
| 3,833,185 | 9/1974 | Talavera | 242/199 |
| 3,889,795 | 6/1975 | Garberi et al. | 197/151 |
| 3,915,409 | 10/1975 | Satou | 242/199 |

FOREIGN PATENTS OR APPLICATIONS

| | | | |
|---|---|---|---|
| 1,813,193 | 8/1970 | Germany | 197/151 |

*Primary Examiner*—Edgar S. Burr
*Assistant Examiner*—Paul T. Sewell
*Attorney, Agent, or Firm*—Peter S. Lucyshyn

[57] ABSTRACT

A ribbon tensioning device for use in a single pass typewriter and/or printer ribbon cartridge having a supply spool and a takeup spool between which the ribbon is transferred incrementally by a capstan drive assembly, includes first and second arms joined at first ends and mounted for pivotal movement thereat in the cartridge adjacent the ribbon spools. The arms are biased in opposing relation with the free ends of the arms engaging the peripheries of respective spools, each arm exerting a pressure against a corresponding spool to maintain the tension on the ribbon extending therebetween substantially constant throughout the transfer thereof between spools. A high friction material is applied to the arm of the device which engages the supply spool and a low friction roller is mounted on the arm of the device which engages the takeup spool. As the diameters of the spools increase and decrease, respectively, during transfer of the ribbon, the tensioning device pivots correspondingly to maintain the force provided by the arms substantially constant and as such to maintain the ribbon tension substantially uniform.

7 Claims, 4 Drawing Figures

Fig. 1.
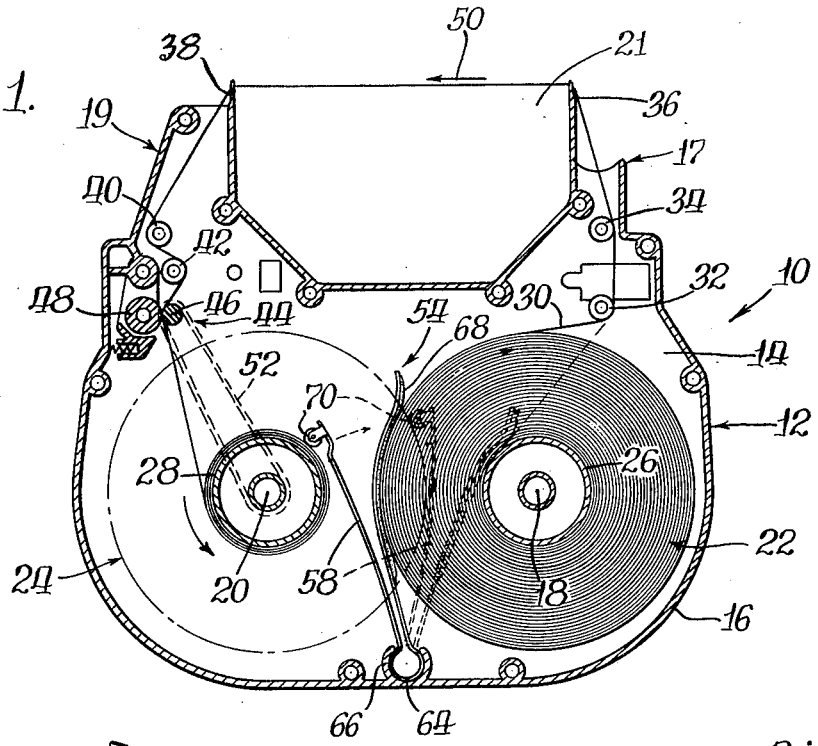
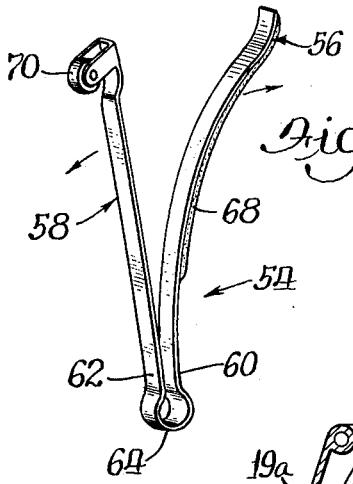
Fig. 2.
Fig. 4.
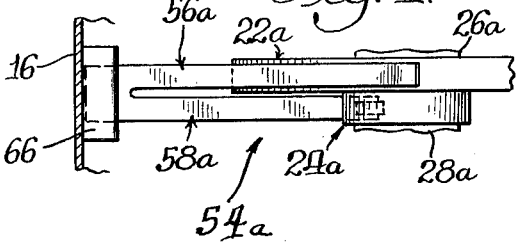
Fig. 3.
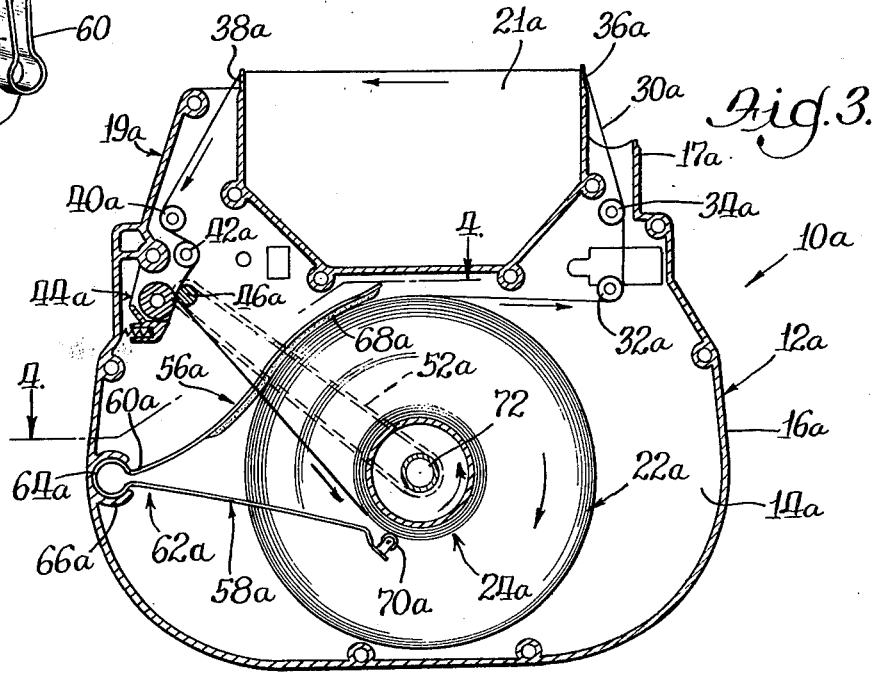

RIBBON TENSIONING DEVICE FOR RIBBON CARTRIDGE

BACKGROUND OF THE INVENTION

This invention relates generally to ribbon cartridges for use in typewriters and/or printers employed in word processors, line printers and the like and more particularly to a ribbon tensioning device for use in such a cartridge which minimizes the spilling of the ribbon as it is transferred from a supply spool onto a takeup spool.

Ribbon cartridges containing inked ribbons used in typewriters and/or printers are conventionally of the type wherein the ribbon is of the single pass variety, i.e. it is not reuseable as in the case of the older type ink impregnated cloth ribbons. During use, the ribbon passes only once through the cartridge from a supply spool to a takeup spool. After the ribbon has been transferred to the takeup spool, the cartridge is discarded and replaced with a fresh one.

Cartridges of the type described which are presently available are for the most part satisfactory in operation, however, there is the tendency for the ribbon to spill from the supply spool in the cartridge after a quantity of the ribbon has been wound onto the takeup spool. It is thought that the tension on the ribbon is reduced below that which is necessary to maintain the ribbon properly on the spools. In time, this can cause a jamming of the ribbon in the cartridge. If this occurs, it becomes necessary to replace the cartridge prior to making use of all the ribbon therein. This wastes ribbon and increases the cost thereof to the user.

It has been found that to prevent or at least minimize the spilling of ribbon in cartridges of the type described, a substantially uniform tension on the ribbon is required during movement of the length of the ribbon in the cartridge from the supply to the takeup spool. In some cases, ribbon lengths may be as great as 500 feet and as such this becomes a rather difficult task.

To overcome this problem, tensioning belts and brake devices have been employed in such ribbon cartridges in an attempt to provide a uniform tensioning of the ribbon during playout. The belts while improving the situation somewhat, have not provided a satisfactory solution to the problem. When the belts are used, a decrease in tension nevertheless occurs as the ribbon is played out and as such spilling may result. In the case of the spool brakes, too great a tension can be placed on the ribbon as it is played out and as such the ribbon may break.

In other fields of technology related somewhat to ribbon cartridges, individual leaf spring brake arms have been provided in magnetic tape cartridges to provide a tensioning on the magnetic tape as it is transferred between a pair of spaced spools. The brake arms function independently and as such would appear to apply a decreasing tension on the supply spool as the magnetic tape is played out therefrom and an increasing tension on the takeup spool as the magnetic tape is taken up thereon. Consequently, this type of arrangement if applied to a ribbon cartridge would not be satisfactory to provide the necessary uniform tension required throughout the transfer of the ribbon so as to minimize the spilling of the ribbon from the ribbon spools. Other over-center or toggle spring devices have been used in magnetic tape cartridges as well to prevent unspooling or entangling of the tape while the tape is being rewound. These devices likewise would not suffice to provide a proper uniform tension in a ribbon cartridge for a typewriter or printer in which the ribbon passes only once from a supply spool to a takeup spool during operation thereof.

SUMMARY OF THE INVENTION

Accordingly, it is a primary object of the present invention to provide in a ribbon cartridge including a single pass ribbon for use with a typewriter and/or printer of the type described, a ribbon tensioning device which supplies a substantially uniform ribbon tension during the movement of substantially the entire length of ribbon from the supply spool to the takeup spool.

It is another object of the present invention to provide a ribbon tensioning device which engages the ribbon itself wound on the ribbon spools to maintain a substantially uniform tension on the ribbon as it is transferred from the supply spool to the takeup spool and which successfully accommodates the decreasing and increasing diameters of the supply and takeup spools, respectively, as the ribbon is transferred, while maintaining such tension.

It is yet another object of the present invention to provide a tensioning device of the above-described type which is relatively simple in design, inexpensive to fabricate and yet is efficient and effective in operation.

Briefly, a preferred embodiment of the ribbon cartridge according to the invention includes an outer housing in which there is mounted first and second spaced spindles. Supply and takeup spools are mounted on the spindles, respectively for rotation thereon, the former being wound with a single pass inked ribbon. The ribbon passes through the cartridge from the supply spool, through a first outwardly extending arm, across a gap into which a printer element is received when the cartridge is placed on a typewriter or printer, into a second arm of the cartridge extending parallel to the first arm, between a driven capstan and idler roller and onto the takeup spool. The capstan is rotated by instrumentalities provided in the printer to drive the ribbon incrementally onto the takeup spool. A slip drive belt is provided between the capstan and takeup spool to drive the latter during operation. Accordingly, the takeup spool is rotated thereby to wind the used ribbon onto the spool. The driving of the ribbon by the capstan causes the supply spool to rotate as well.

To provide substantially uniform tension to the ribbon throughout the time of transfer thereof from spool to spool, there is provided, between the spools, a ribbon tensioning device according to the invention. A preferred embodiment of the device includes a one-piece leaf spring which is formed into a generally V-shape, the arms of the V being tensioned in opposing directions so that each arm engages the outer ribbon periphery of one of the supply and takeup spools. The point of joinder of the arms is mounted for pivotal rotation in the cartridge at a location between the spaced spools. A high friction material is provided on the free end of the arm engaging the ribbon wound about the supply spool to increase the friction therebetween and a small roller is provided at the end of the other arm which engages the ribbon wound about the takeup spool to decrease friction between the arm and ribbon.

In operation, the arms maintain substantially constant tension on the ribbon, adjusting to accommodate the change in diameters of the spools as the ribbon is played out and taken up. Because of the pivotal mounting at the joinder of the arms, the entire tensioning device is permitted to rotate thereabout to shift the positioning of the arms in accordance with the change in spool diameters.

In the case of a ribbon cartridge wherein the spools are mounted in axial alignment, a similar tensioning device is employed wherein the arms thereof are biased in opposing relation. In this case, however, the arms are biased toward each other to engage the ribbon peripheries of the respective spools, thereby maintaining a substantially uniform tension thereon as the ribbon passes therebetween.

DESCRIPTION OF THE DRAWING

In the drawing:

FIG. 1 is a sectioned, plan view of a ribbon cartridge having a pair of ribbon spools in spaced, side-by-side relation in which there is provided a first embodiment of a uniform ribbon tensioning device according to the invention;

FIG. 2 is a perspective view of the ribbon tensioning device of FIG. 1;

FIG. 3 is a plan view of a ribbon cartridge having a pair of ribbon spools mounted in spaced axial alignment in which there is provided a second embodiment of a uniform ribbon tensioning device according to the invention; and FIG. 4 is a partially sectioned fragmentary side view of the ribbon tensioning device of FIG. 3.

DETAILED DESCRIPTION OF THE DRAWING

Referring now to the drawing in greater detail wherein like numerals have been employed in the various views to designate similar components, there is illustrated in FIG. 1, a preferred embodiment of a ribbon cartridge 10 for use with a typewriter and/or printer such as that employed in a word processor, including a ribbon tensioning device according to the invention.

The cartridge includes an outer housing constructed of a plastic or the like material formed by molding or other suitable processes. The housing comprises upper and lower walls, only the lower one 14 of which is shown, and a side wall 16 extending about the periphery of the cartridge housing between the upper and lower walls. A pair of spaced outwardly extending arm portions 17, 19 are formed integrally as a part of the cartridge housing. A gap 21 provided therebetween permits the reception therein of a type element employed in a variety of typewriters and/or printers with which the ribbon cartridge as shown is designed for use. The arms aid in mounting the ribbon onto the ribbon lifter assembly (not shown) employed in such typewriters and printers for raising and lowering the ribbon during printing.

A pair of spindles 18, 20 extend upwardly from the lower wall 14 of the cartridge housing to support thereon ribbon supply and takeup spools 22, 24, respectively. The ribbon spools each include a central hub such as 26, 28, mounted on the spindles 18, 20, respectively, for rotation. The supply spool is wound with ribbon 30 which is to be incrementally transferred therefrom to the takeup spool 24 during the printing process. The ribbon extends from the supply spool about rollers such as 32, 34, out of the cartridge through arm portion 17, over guide 36, across gap 21, over guide 38 formed on arm portion 19, into the cartridge housing through arm portion 19, about rollers 40, 42 and onto hub 28 of the takeup spool 24.

A capstan and idler wheel ribbon drive assembly 44 is provided in the housing mounted on the lower wall 14 thereof. The capstan is driven rotatably by cooperating instrumentalities in the typewriter or printer to which the capstan is coupled upon installation of the cartridge in the printer. The ribbon 30 passes between the capstan 46 and idler wheel 48 and is held tightly thereby so that upon rotation of the capstan, the ribbon is moved in the direction of arrow 50.

As the ribbon is driven incrementally by the capstan 46, the ribbon is transferred from supply spool 22 to takeup spool 24. The particular ribbon 30 is of the type which passes only once between the supply and takeup spools during use. Thereafter, the cartridge is discarded. This type of ribbon is referred to as a single pass ribbon.

A slip drive belt 52 shown in dotted lines is provided in the cartridge to insure the rotation of the takeup spool during the transfer of the ribbon. As the capstan is rotated to drive the ribbon the belt 52 rotates the hub 28 on spindle 20. The belt is permitted to slip because as additional ribbon is wound onto the takeup spool the amount of movement required by the spool to accept the length of ribbon transferred by the rotation of the capstan changes. Thus, if the belt slips, no spilling or breakage of the ribbon occurs because of under or over driving of the spool 24.

To provide a uniform tension on the ribbon 30 throughout its movement between the supply spool 22 and takeup spool 24, regardless of the amount of ribbon present on either spool, there is provided the ribbon tensioning device 54 according to the invention. A preferred embodiment of the tensioning device includes a one-piece, flat, metal or the like spring member of generally V-shape, having first and second arms 56, 58, respectively. The arms are joined at first ends 60, 62, in the preferred embodiment, to form a substantially rounded end or base 64 of substantially circular shape. The rounded end 64 is received in a complementarily shaped cavity formed by a member 66 extending from the lower wall 14 of the cartridge housing on a line extending between the ribbon spools 22, 24. The arms 56, 58 of the tensioning device are biased in opposing directions, in FIGS. 1 and 2 in an outward direction away from each other (see arrows, FIG. 2), so that when mounted in the cartridge as shown in FIG. 1, the arms engage ribbon peripheries of respective spools 22, 24. The ribbon tensioning device is easily installed into a ribbon cartridge after the spools are mounted therein.

A high friction material 68 (FIG. 2) is provided on the surface of the spring arm 56 which engages the ribbon wound about supply spool 22 and a low friction roller 70 is provided on the arm 58 for engaging the ribbon wound about takeup spool 24. It has been found that it is desirable to have a high friction coupling between the tensioning device and supply spool and a low friction coupling at the takeup spool to minimize spilling and breakage of the ribbon as it is transferred.

The force provided by the arms of the tensioning device remains substantially the same during the transfer of the ribbon from the supply spool to the takeup spool. This is due to the pivotal movement of the spring device about end 64 thereof. The entire tensioning device pivots as the ribbon is played out from the supply spool due to the increase and decrease in diameters of the takeup and supply spools, respectively, during ribbon transfer. The latter permits the biasing force provided by the arms of the spring tensioning device to remain substantially constant throughout the transfer.

In operation, the diameter of the supply spool is greatest when the cartridge is first installed on a typewriter or printer. Thus, the tensioning device assumes the position as shown in solid lines in FIG. 1. As the ribbon is played out and transferred from the supply spool to the takeup spool, the diameter of the supply spool decreases and the diameter of the takeup spool increases. As the latter occurs, the tensioning device is pivoted about end 64 so that the relationship between arms 56, 58, of the tensioning device with respect to each other, remains substantially constant. Consequently, substantially the same force is provided by the arms against the ribbon on respective spools as the spools decrease and increase in diameter, respectively, and as such the force on the ribbon 30 is maintained substantially constant throughout the transfer of the ribbon from the supply to the takeup spool. It should be noted that in actual practice, the gap between the spools will vary slightly as the ribbon is transferred from the supply to the takeup spool. This variance, however, is sufficiently small that the force provided against the ribbon peripheries by the arms of the tensioning device remains substantially constant. The gap size can be controlled to vary only a minimal amount by selecting the hub diameters (26,28) properly.

A second embodiment of a ribbon cartridge 10*a* employing a modified ribbon tensioning device 54*a* according to the invention is shown in FIGS. 3 and 4 of the drawing. The cartridge 10*a* also includes a housing 12*a* having upper and lower walls, only the lower one 14*a* of which is shown. A side wall 16*a* extends about the housing between the upper and lower walls. The housing likewise includes a pair of spaced arm portions 17*a*, 19*a* out of and into which the ribbon 30*a* passes respectively, as it traverses the path from the supply spool 22*a* to the takeup spool 24*a*.

A single spindle 72 extends upwardly from the lower wall 14*a* of the cartridge housing to support both the supply and takeup spools 22*a*, 24*a*. The central hubs 26*a*, 28*a* of the spools, respectively, are mounted for independent rotation on spindle 72. The supply spool 22*a* is mounted in axial alignment with the takeup spool 24*a*.

The ribbon 30*a* is fed from supply spool 22*a* over rollers 32*a*, 34*a*, outwardly from the cartridge housing 12*a* through arm portion 17*a*, over guide 36*a*, across gap 21*a*, over guide 38*a* on arm portion 19*a*, into arm portion 19*a*, around rollers 40*a*, 42*a* and through capstan and idler roller assembly to takeup spool 24*a*. Capstan 46*a* of the last-mentioned assembly drives the ribbon incrementally to transfer the ribbon from supply spool 22*a* to takeup spool 24*a*. A slip drive belt 52*a* is coupled from capstan 46*a* to hub 28*a* of the takeup spool to insure proper rotation thereof as the ribbon is transferred.

The ribbon cartridge 12*a* also includes a ribbon tensioning device 54*a* which applies a substantially uniform tension to the ribbon 30*a* as it is transferred between spools to insure that the ribbon will not be spilled nor become too tight and break. The ribbon tensioning device 54*a* includes a one-piece, flat, metal or the like spring member of generally V-shape, having first and second arms 56*a*, 58*a*, respectively. The arms are joined at first ends 60*a*, 62*a* to form a substantially rounded end on base 64*a* of generally circular shape. The last-mentioned end is mounted in a circular cavity defined by member 66*a* extending upwardly from the wall 14*a* of housing 12*a* and the tensioning device is pivotal therein.

In the case of tensioning device 54*a*, the arms 56*a*, 58*a*, are biased also in opposing directions, but in this instance, toward each other for engagement with the ribbon peripheries of spools 22*a* and 24*a*, respectively. As in the case of the tensioning device 54, device 54*a* includes high friction material 68*a* and a low friction roller 70*a* on the free ends of the arms 56*a* and 58*a*, respectively, thereof.

Because the rollers 26*a*, 28*a* are in axial alignment with respect to each other, it is necessary to form arms 56*a*, 58*a* of the tensioning device offset with respect to each other and in different planes as shown in FIG. 4. In this fashion, the arms are aligned with respective ribbon spools for proper engagement with the ribbon peripheries thereof during the transfer of the ribbon from the supply to the takeup spool.

In operation, the tensioning device 54*a* functions in a similar manner as device 54 of FIGS. 1 and 2. As the ribbon is transferred from the supply to the takeup spool, the tensioning device 54*a* pivots about end 64*a* in cavity 66*a*, to maintain the force provided by arms 56*a*, 58*a* against the ribbon respective spools proper and as such to maintain the tension on ribbon 30*a* substantially uniform throughout the transfer thereof from the supply to the takeup spool.

From the above, it can be seen that the ribbon tensioning device according to the invention, provides a simple yet effective means to insure substantially uniform tension on the ribbon 30, 30*a* of ribbon cartridges 10, 10*a*, respectively, during the passage of the ribbon from the supply spool to the takeup spool thereof, thus minimizing spilling of the ribbon and/or breakage thereof during transfer.

While the preferred embodiments of the ribbon tensioning device have been shown and described as a one-piece spring member, it will be obvious to one skilled in the art that the tensioning device could be fabricated as a multi-piece device having separate arms joined together at a first end and mounted thereat at a predetermined location in the cartridge for pivotal movement. While the fabrication of the last-mentioned embodiment of the device may be more costly, the functioning thereof would be like that of the one-piece device as shown and described herein. It should be understood that the invention is not limited to the particular embodiments described since many modifications may be made therein. It is therefore contemplated to cover by the present application, any and all such modifications as fall within the spirit and scope of the appended claims.

What we claim is:

1. In a single pass ribbon cartridge for use in a typewriter, printer and the like, comprising a housing having mounted therein a ribbon supply spool and a takeup spool, a length of ribbon mounted on said supply spool and extending therefrom along a predetermined path out of and back into said housing to said takeup spool and a ribbon driving assembly, said driving assembly being drivable incrementally to transfer said ribbon from said supply spool to said takeup spool, the improvement comprising;

a ribbon tensioning device for providing a substantially uniform tension to said ribbon as it is transferred between said supply and takeup spools, said tensioning device including first and second arms coupled at first ends to each other to form a base, said device being mounted at said base for pivotal movement adjacent said ribbon spools, said arms being biased in opposing directions with the free ends of said arms being predeterminedly spaced and each engaging the ribbon wound about a respective one of said ribbon spools to exert a predetermined pressure thereagainst, said tensioning device being pivoted about said base as the ribbon diameters of said supply and takeup spools decrease and increase, respectively, during transfer of said ribbon from said supply to said takeup spool and said tensioning device further including means to create a predetermined differential in frictional coupling between the free end of a first one of said arms and the ribbon wound about said supply spool and the free end of the second one of said arms and the ribbon wound about said takeup spool, the frictional coupling between the free end of said first arm and ribbon wound about said supply spool being substantially greater than the frictional coupling between the free end of said second arm and the ribbon wound about said takeup spool, whereby a substantially uniform tension is maintained on said ribbon with a minimum of spilling and breakage thereof during transfer from said supply to said takeup spool.

2. A ribbon tensioning device as claimed in claim 1 wherein said cartridge spools are mounted in spaced, side-by-side relation, wherein said tensioning device is mounted along a line extending between said spools and wherein said arms are biased in an opposing outward direction into engagement with the ribbon wound about respective spools.

3. A ribbon tensioning device as claimed in claim 1 wherein said tensioning device comprises a one-piece generally V-shaped spring member formed with first and second arms biased in opposing directions into engagement with the ribbon wound about respective ones of said supply and takeup spools.

4. A ribbon tensioning device as claimed in claim 3 wherein the base of said V-shaped spring member is formed into a rounded end portion and wherein said cartridge housing includes a complementarily shaped cavity for receiving said base of said spring member, said rounded spring end being pivotal within said cavity.

5. A ribbon tensioning device as claimed in claim 1 further including high friction means applied to the free end of said first arm member for engagement with the ribbon wound about said supply spool to create a high friction coupling between said ribbon and said arm and low friction means applied to the free end of said second arm for engagement with the ribbon wound about said takeup spool to create a low friction coupling between said ribbon and said arm.

6. A ribbon tensioning device as claimed in claim 5 wherein said low friction means includes a roller coupled to the free end of said arm for rolling engagement with the ribbon wound about said takeup spool.

7. A ribbon tensioning device as claimed in claim 1 wherein said spools are mounted in axial alignment, wherein said tensioning device is mounted adjacent said spools and wherein said arms are biased toward each other into engagement with the ribbon wound about said supply and takeup spools.

* * * * *

UNITED STATES PATENT OFFICE

CERTIFICATE OF CORRECTION

Patent No. 4,013,160 Dated March 22, 1977

Inventor(s) Paul S. Colecchi et al.

It is certified that error appears in the above-identified patent and that said Letters Patent are hereby corrected as shown below:

Column 6, line 2, "on" should read -- or --.

Column 6, line 28, after "ribbon" -- on -- should be inserted.

Signed and Sealed this

Seventh Day of June 1977

[SEAL]

*Attest:*

RUTH C. MASON
*Attesting Officer*

C. MARSHALL DANN
*Commissioner of Patents and Trademarks*